United States Patent [19]

Maruyama

[11] Patent Number: 4,990,070

[45] Date of Patent: Feb. 5, 1991

[54] ROTARY SCREW PUMP WITH SUCTION VANES AT INTAKE PORT

[75] Inventor: Hiroshi Maruyama, Kobe, Japan

[73] Assignee: Heishin Sobi Kabushiki Kaisha, Kobe, Japan

[21] Appl. No.: 349,039

[22] Filed: May 9, 1989

[30] Foreign Application Priority Data

May 20, 1988 [JP] Japan ..... 63-124087

[51] Int. Cl.[5] ..... F04C 5/00; F04C 15/02

[52] U.S. Cl. ..... 418/48; 418/181; 241/185 A

[58] Field of Search ..... 418/48, 181; 417/201, 417/203; 241/185 A, 186 A

[56] References Cited

U.S. PATENT DOCUMENTS

| | | | |
|---|---|---|---|
| Re. 29,626 | 5/1978 | Allen | 418/48 |
| 2,505,136 | 4/1950 | Moineau | 418/48 |
| 2,957,427 | 10/1960 | O'Conner | 418/48 |
| 3,216,768 | 11/1965 | Soeding et al. | 418/48 |
| 3,627,453 | 12/1971 | Clark | 418/48 |
| 4,108,386 | 8/1978 | Conery et al. | 241/185 A |
| 4,591,322 | 5/1986 | Ono et al. | 418/48 |

FOREIGN PATENT DOCUMENTS

| | | | |
|---|---|---|---|
| 2321585 | 5/1975 | Fed. Rep. of Germany | 418/48 |
| 60-142078 | 7/1985 | Japan . | |
| 62-29781 | 2/1987 | Japan . | |

OTHER PUBLICATIONS

Moyno Powder Pumps, Bulletin No. 110–B, dated 1964 Robbins & Myers Inc.

Japanese Publication Titled: The Mono Pump.

*Primary Examiner*—John J. Vrablik

*Assistant Examiner*—David L. Cavanaugh

*Attorney, Agent, or Firm*—Marshall, O'Toole, Gerstein, Murray & Bicknell

[57] ABSTRACT

This disclosure relates to an improved vertical type uniaxial eccentric screw pump for transferring a variety of powders such as flour, cement and pigment. The vertical type uniaxial eccentric screw pump, without jetting compressed air inside the pump, directly sucks powder contained in a vessel through a suction port in the lower end of the pump and transfers the powder to any desired place. An eccentric screw pump includes a stator and a rotor, and a propeller shaft projects from the lower end of the male thread type rotor. Vanes for sucking powder are mounted on the shaft, and a powder delivery port is formed in the pump casing close to the discharge port at the upper end of the stator.

11 Claims, 3 Drawing Sheets

ROTARY SCREW PUMP WITH SUCTION VANES AT INTAKE PORT

FIELD AND BACKGROUND OF THE INVENTION

The present invention relates to an uniaxial eccentric screw pump for transferring a variety of powder substances such as flour, cement, or pigment.

Uniaxial eccentric screw pumps have been used in the past for transferring liquids. Such screw pumps are of two general types, a horizontal type which is used in a horizontal orientation and a vertical type which, of course, is used in a vertical orientation. The basic configuration of both types is, for example, as described in Japanese Provisional Publication No. SHO-60-142078 and Japanese Provisional Publication No. SHO-62-29781, such that a rotor having the shape of a spiral male thread with a circular cross section is mounted in a stator having the shape of a spiral female thread which forms a cavity with an oval cross section. The rotor is rotated around an eccentric center line by means of a connecting rod connected to a drive shaft of a driving unit. A material to be pumped or transferred is sucked into the stator under the influence of the pumping effect produced by the rotor with the circular cross section rotating in the cavity with the oval cross section. The material moves along the major axis of the oval section of the cavity, and the material is discharged from one end of the stator.

Uniaxial eccentric screw pumps of the foregoing types are, as mentioned above, in use mainly for transferring liquid and are said not to be fit to transfer a powder. Only the type of pump of FIG. 3 was available as an uniaxial eccentric screw pump for transfer of powder material. A prior art pump for powder transfer is, as shown in FIG. 3 of the drawings, of the horizontal type. A powder feed inlet (e) (formed by a hopper) is formed in a pump casing (a) adjacent a suction chamber (k) which is close to the coupling between a rotor (c) and a connecting rod (d). Powder is charged into the suction chamber (k) through the powder feed inlet (e), and the powder is then passed through a cavity in a stator (b) and discharged out of a powder discharge port (f) and a discharge nozzle (j). Jet ports (g) and (h) for compressed air jets are provided in the bottom of the suction chamber (k) and near the powder discharge port (f), respectively, producing air streams which assist the transfer of powder. Accordingly, powder which is fed through the powder feed port (e) is fluidized by the air supplied from the jet port (g) of compressed air, and the powder is transferred out of the discharge nozzle (j) under the influence of the flow of compressed air jetted out of the compressed air jet port (h).

One popular conventional method for transferring powder is the so-called pneumatic conveying in which compressed air is blown into a powder transfer tube by a blower or the like, and powder contained in a hopper or the like is fed into the transfer tube at a constant rate by means of a feeder, to be transported by the air stream to a desired destination.

There are, however, problems with the foregoing prior art structures. To operate the above-mentioned conventional uniaxial eccentric screw pump for powder transfer, it is necessary to feed powder into the feed inlet (e) in advance of the start of powder transfer. It, therefore, is not possible to directly suck in powder contained in a vessel such as a drum by means of the pump so as to transfer it to a desired place. Further, jetting of compressed air out of the jet port (g) of the suction chamber (k) is indispensable. If air is not jetted out of the jet port (g), powder fed into the feed inlet (e) may form a bridge and prevent powder from being sucked into the cavity of the stator (b).

In the case of transferring powder by the above-mentioned pneumatic conveying, it is necessary to separate the air by means of a bag filter, etc. after the transfer since the powder is transferred with a volume of air which is several times as large as that of powder. Hence the blower or the like must have a very large capacity, resulting in a large-sized apparatus. Furthermore, as is the case of the conventional screw pump, powder should be charged in advance in the hopper or the like.

The present invention has the purpose to solve the above-mentioned problems of the conventional apparatus. In particular, it provides a vertical type uniaxial eccentric screw pump which is capable of, without jetting compressed air inside the pump, directly sucking in powder contained in a vessel through a suction port provided in the lower end of the pump and transferring the powder to a desired place.

SUMMARY OF THE INVENTION

A pump in accordance with the present invention is an uniaxial eccentric screw pump in which a male thread type rotor is rotated in a female thread type stator by a drive means. The rotor has a propeller shaft projecting out of one end thereof, the shaft projecting out of a suction or intake port, and the shaft is provided with vanes for sucking powder into the intake port. A powder delivery port is provided in the pump casing close to a discharge at the other end of the stator.

The pump is preferably a vertical type and the intake port is at the lower end of the stator-rotor.

When, for example, powder contained in a vessel is to be transferred to another place by means of the vertical type uniaxial eccentric screw pump according to the present invention, the suction port at the lower end of the pump is located on the powder contained in the vessel. When the rotor is turned by the drive means, the suction vanes in the suction port turn together with the rotor, and the powder contained in the vessel is agitated, fluidized and sucked into the stator. The powder sucked into the stator is transferred to the discharge port end vigorously under the influence of the pumping action of the rotor and stator, and the powder is transferred out of the powder delivery port in the pump casing close to the discharge port (through a transfer tube) while the velocity of the powder flow is not lost.

It is desirable to provide a cylindrical guard surrounding the suction vanes on the lower end of pump casing. With this arrangement, the suction vanes are protected by the guard.

Furthermore, in order to improve the suction capability of the suction port portion, in addition to the large-sized suction vanes mounted on the lower end of the shaft, smaller-sized suction vanes may be mounted on an intermediate portion of the shaft, and a powder suction cylinder surrounding the small sized suction vanes may be provided on the lower end of the pump casing. With this arrangement, in the powder suction port portion, the large-sized suction vanes and the small-sized suction vanes in the suction cylinder will turn simultaneously to suck powder into the stator. In particular, the small-sized suction vanes have a greater suction force since they are turned inside the suction cylinder.

Moreover, vanes for agitating powder may be mounted on a connecting rod of the drive means above the powder delivery port, and a shielding plate may be mounted around the connecting rod just above the agitating plate. A ring-shaped groove member may be formed in the pump casing into which the circumference of the shield plate may be rotatably inserted. With this arrangement, upon rotation of the agitating vanes, powder near the discharge port is agitated to become fluidized, and blocking of the channel due to compaction of the powder is prevented. Furthermore, the powder is prevented from flowing into the upper portion of the casing by the shield plate.

When the transfer distance is relatively great, a jet port of compressed air (typically 1–3 kg/cm$^2$) may be provided near the discharge port of the stator, or jet ports may be provided near the discharge port and also near the suction port. With this arrangement, transfer of powder is facilitated by the compressed air jetted out near the discharge port of the stator, or near the discharge port of the stator and near the suction port, and the powder may be transferred over a long distance.

BRIEF DESCRIPTION OF THE DRAWINGS

The invention will be better understood from the following detailed description of a preferred embodiment of the invention, when taken in conjunction with the accompanying drawings, wherein.

DETAILED DESCRIPTION OF THE DRAWINGS

Figure 1:
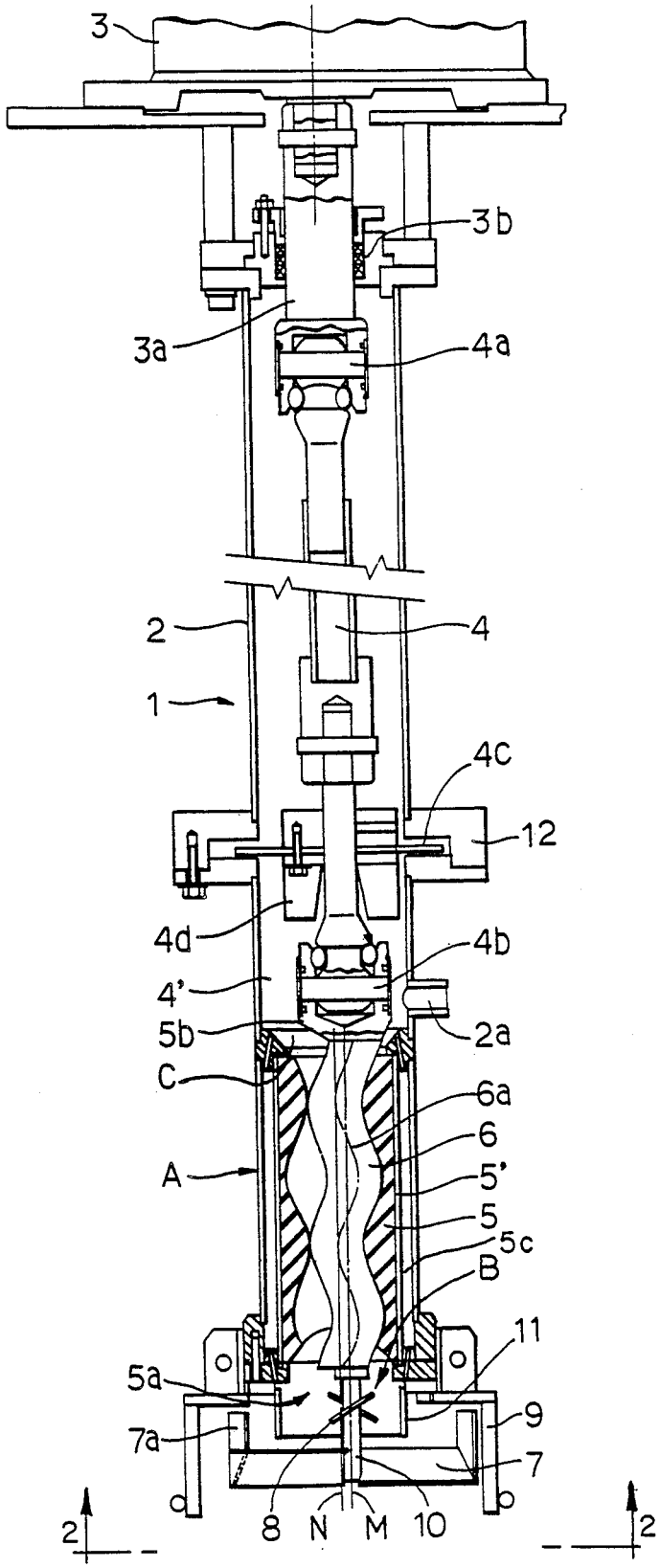
FIG. 1 is a vertical sectional view of an embodiment of a vertical type uniaxial eccentric screw pump according to the present invention.
Figure 2:
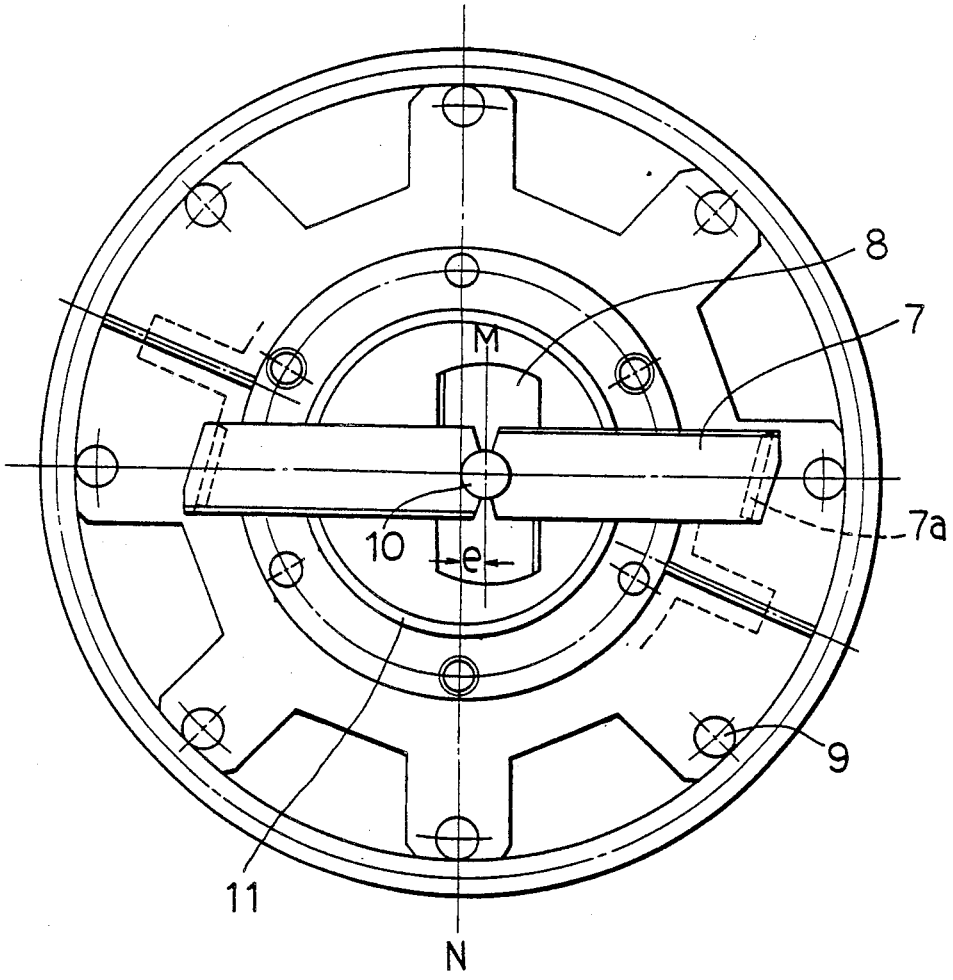
FIG. 2 is a bottom view of the pump taken on the line 2—2 of FIG. 1.
Figure 3:
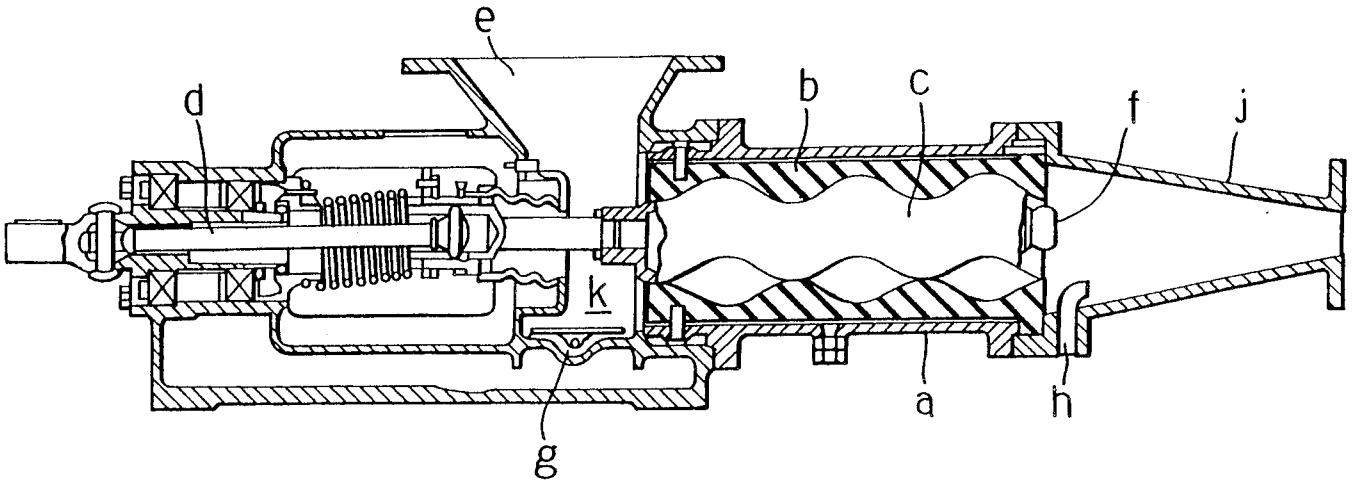
FIG. 3 PRIOR ART
FIG. 3 is a vertical sectional view of a conventional apparatus.

In FIG. 1, an eccentric screw pump 1 is driven by a driving unit (motor) 3 mounted on the upper end of a tubular pump casing 2. A drive shaft 3*a* of the motor 3 extends into the pump casing 2 and is rotatably supported by a bearing 3*b*. The major portion of the pump 1 comprises a male thread type rotor 6 of which the cross section is circular, and a female thread type stator 5 which has a cavity that is oval in cross section and has a pitch twice as large as that of the rotor 6. The rotor 6 is rotatably mounted in the stator 5. The stator 5 is contained in a cylindrical casing 5' and is located in the lower end portion of the pump casing 2, with a gap 5*c* around the casing 5'. The rotor 6 is coupled to the drive shaft 3*a* of the motor 3 via a connecting rod 4. Under this condition, the axis M of rotation of the rotor 6 is eccentric by an amount (e) (see FIG. 2) to the axis N of rotation of the drive shaft 3*a*. To allow for the eccentric rotation of the rotor 6, universal joints 4*a* and 4*b* are provided between the connecting rod 4 and the drive shaft 3*a*, and between the connecting rod 4 and the rotor 6, respectively. On the side of a suction port 5*a* at the lower end of the stator 5, a shaft 10 is provided which is connected to and projects downwardly from the center of the lower end of the rotor 6. On the lower end of the shaft 10, a pair of large-sized suction or fan vanes 7 are mounted slantwise so as to generate an upward suction force upon counterclockwise rotation (as seen in FIG. 2) of the shaft 10 and the vanes 7. A pair of smaller-sized suction vanes 8 are similarly mounted slantwise on an intermediate portion of the shaft 10 so as to also generate an upward suction force. At the top end of each suction vane 7, a vertical auxiliary vane 7*a* is mounted slantwise so as to direct powder towards the center of the shaft 10. Furthermore, a fence-like cylindrical guard 9 is mounted on the lower end of the pump casing 2 and surrounds the suction vanes 7 and 7*a*. Moreover, a cylindrical suction column 11 is mounted inside the guard 9 at the lower end of the pump casing 2, the suction column 11 surrounding the suction vanes 8.

The numeral 2*a* denotes a powder delivery port adjacent the upper end of the rotor 6, and this delivery port 2*a* is located as close as possible to a discharge port 5*b* at the upper end of the stator 5 in the pump casing 2. Above the discharge port 5*b* and around the connecting rod 4, a shield plate 4*c* is provided on the rod 4, in the form of a circular plate. On the lower surface of the shield plate 4*c*, a pair of agitating vanes 4*d* are mounted slantwise in a direction which allows the powder to be dispersed towards the circumference of the pump casing 2. In the pump casing 2 around the shield plate 4*c*, a ring-shaped groove member 12 is formed into which the circumference portion of the shield plate 4 is rotatably received. In FIG. 1, 4' is a discharge chamber formed between the shield plate 4*c* and the stator 5.

Now, the operation of the pump according to the above-mentioned embodiment will be described. When, for instance, powder contained in a vessel (not shown) is to be transferred to another place, the guard 9 near the suction port 5*a* at the lower end of the stator 5 is placed on the powder in the vessel. Then the rotor 6 is rotated by the motor 3. Together with the rotor 6, the suction vanes 7 and 8 mounted on the shaft 10 located at the lower end of the rotor 6 are turned. The powder in the vessel is agitated and fluidized by the air movement produced by the suction vanes 7 and 8, and the powder is then sucked into the cavity of the stator 5. The powder sucked into the stator 5 is transferred vigorously through the stator 5 towards the discharge port 5*b* under the influence of the pumping action of the stator 5 and the rotor 6, and it enters the discharge chamber 4'. While the flow velocity of the powder is not lost, the powder is transferred out of the powder delivery port 2*a* in the pump casing 2, the delivery port 2*a* being close to the discharge port 5*b*, and the powder is transferred through a transfer tube (not illustrated) connected to the delivery port 2*a*. Powder in the upper portion of the delivery chamber 4' is agitated and fluidized by the agitating vanes 4*d*, and is dispersed towards the circumference of the discharge chamber 4' and is moved out of the delivery port 2*a*. Hence powder will not become stagnant in the discharge chamber 4'. Furthermore, since the top end of the discharge chamber 4' is shielded by the shield plate 4*c*, the powder will not invade into the upper portion of the pump casing 2 above the plate.

When the transfer distance of powder is very large, for example, a feed line of compressed air (typically 1–3 kg/cm$^2$) may be connected to the position marked with an arrow A in FIG. 1 so as to feed compressed air into the gap 5*c* between the pump casing 2 and the casing 5' of the stator 5. In addition, jet ports connected to the gap 5*c* may be opened at positions indicated by the arrows B and C so as to jet out compressed air near the suction port 5*a* and the discharge port 5*b* of the stator 5. When only one jet port is to be provided, it is more effective to provide it near the discharge port 5b (arrow C).

In addition, the pump 1 according to the present invention is capable of transferring powder contained in a vessel or the like to a desired place not only when the pump 1 is vertical as mentioned above but also when the pump 1 is tilted.

The vertical type uniaxial eccentric screw pump for powder transfer according to the present invention has the following effects:

(1) Unlike the conventional pumps for powder transfer, the present pump is capable of transferring powder without jetting compressed air within the pump. As a result, no compressed air sources are required, and the overall configuration of the apparatus is simple, including the structure of the pump itself. Furthermore, as the air volume to be sucked in together with the powder during sucking of the powder is very small, there is no need for air separation after transfer which is required in the case of conventional pneumatic conveying, and blowers of large capacity are not required.

(2) As the pump is capable of directly sucking powder contained in a vessel through the suction port in the lower end of the pump and transferring powder to a desired place, there is no need to feed powder into the feed inlet, which feeding is required in the case of the conventional horizontal type uniaxial eccentric screw pump for powder transfer. Thus the operation is simple.

(3) The suction vanes are protected by the guard.

(4) The pump capacity for sucking powder into the stator is improved.

(5) Clogging of the discharge side flow channel due to compaction of powder is prevented by the agitating action of the agitating vanes, and powder is prevented from entering into the upper portion of the pump casing by the shield plate.

(6) The transfer of powder may be facilitated by compressed air, and this is very advantageous when the transfer distance of powder is extended.

What is claimed is:

1. A vertical type uniaxial eccentric rotary screw pump with suction vanes at intake port for transfer of powder, comprising a female screw type stator including a stator cavity, a screw type rotor in said cavity, wherein said stator and said rotor extend vertically, said rotor being adapted to be eccentrically rotated by a driving means, a powder intake port at the lower end of said stator, a propeller shaft connected to said rotor and projecting from said rotor, said shaft projecting into said powder suction port in said stator, vanes for sucking powder mounted slantwise on said shaft so as to generate an upward suction force upon rotation on said shaft and the vanes, and a powder delivery port formed in said stator adjacent the upper end of said stator, said vanes comprising large-sized suction vanes on the lower end of said shaft, and small-sized suction vanes mounted on an intermediate portion of the shaft.

2. A vertical type uniaxial eccentric rotary screw pump with suction vanes at intake port according to claim 1, and further including a powder suction column surrounding said small-sized suction vanes and mounted on the lower end of said pump casing.

3. A vertical type uniaxial eccentric rotary screw pump with suction vanes at intake port according to claim 2, and further comprising a cylindrical guard surrounding said large-sized suction vanes and mounted on the lower end of said pump casing.

4. A vertical type uniaxial eccentric rotary screw pump with suction vanes at intake port for transfer of powder, comprising a female screw type stator including a stator cavity, a screw type rotor in said cavity, wherein said stator and said rotor extend vertically, said rotor being adapted to be eccentrically rotated by a driving means, a powder intake port at the lower end of said stator, a propeller shaft connected to said rotor and projecting from said rotor, said shaft projecting into said powder suction port in said stator, vanes for sucking powder mounted slantwise on said shaft so as to generate an upward suction force upon rotation on said shaft and the vanes, and a powder delivery port formed in said stator adjacent the upper end of said stator, and agitating vanes mounted on said driving means adjacent said powder delivery port, a shield plate mounted on said driving means adjacent said agitating vanes, and a ring-shaped groove member formed in said stator to rotatably receive the circumference of the shield plate.

5. A vertical type uniaxial eccentric rotary screw pump with suction vanes at intake port for transfer of powder, comprising a female screw type stator including a stator cavity, a screw type rotor in said cavity, wherein said stator and said rotor extend vertically, said rotor being adapted to be eccentrically rotated by a driving means, a powder intake port at the lower end of said stator, a propeller shaft connected to said rotor and projecting from said rotor, said shaft projecting into said powder suction port in said stator, vanes for sucking powder mounted slantwise on said shaft so as to generate an upward suction force upon rotation on said shaft and the vanes, and a powder delivery port formed in said stator adjacent the upper end of said stator, a cylindrical guard provided on the lower end of said pump casing and surrounding said vanes, and agitating vanes mounted on said driving means adjacent said powder delivery port, a shield plate mounted on said driving means adjacent said agitating vanes, and a ring-shaped groove member formed in said stator to rotatably receive the circumference of the shield plate.

6. A vertical type uniaxial eccentric rotary screw pump with suction vanes at intake port for transfer of powder, comprising a female screw type stator including a stator cavity, a screw type rotor in said cavity, wherein said stator and said rotor extend vertically, said rotor being adapted to be eccentrically rotated by a driving means, a powder intake port at the lower end of said stator, a propeller shaft connected to said rotor and projecting from said rotor, said shaft projecting into said powder suction port in said stator, vanes for sucking powder mounted slantwise on said shaft so as to generate an upward suction force upon rotation on said shaft and the vanes, and a powder delivery port formed in said stator adjacent the upper end of said stator, said vanes comprising large-sized suction vanes on the lower end of said shaft, and small-sized suction vanes mounted on an intermediate portion of the shaft, and agitating vanes mounted on said driving means adjacent said powder delivery port, a shield plate mounted on said driving means adjacent said agitating vanes, and a ring-shaped groove member formed in said stator to rotatably receive the circumference of the shield plate.

7. A vertical type uniaxial eccentric rotary screw pump with suction vanes at intake port according to claim 6, and further including a powder suction column surrounding said small-sized suction vanes and mounted on the lower end of said pump casing.

8. A vertical type uniaxial eccentric rotary screw pump with suction vanes at intake port according to claim 7, and further comprising a cylindrical guard surrounding said large-sized suction vanes and mounted on the lower end of said pump casing.

9. A vertical type uniaxial eccentric rotary screw pump with suction vanes at intake port for transfer of powder, comprising a female screw type stator including a stator cavity, a screw type rotor in said cavity, wherein said stator and said rotor extend vertically, said rotor being adapted to be eccentrically rotated by a driving means, a powder intake port at the lower end of said stator, a propeller shaft connected to said rotor and projecting from said rotor, said shaft projecting into said powder suction port in said stator, vanes for sucking powder mounted slantwise on said shaft so as to generate an upward suction force upon rotation on said shaft and the vanes, and a powder delivery port formed in said stator adjacent the upper end of said stator, said vanes comprising large-sized suction vanes on the lower end of said shaft, and small-sized suction vanes mounted on an intermediate portion of the shaft, and a jet port for compressed air provided adjacent at least one of said ports.

10. A vertical type uniaxial eccentric rotary screw pump with suction vanes at intake port according to claim 9, and further including a powder suction column surrounding said small-sized suction vanes and mounted on the lower end of said pump casing.

11. A vertical type uniaxial eccentric rotary screw pump with suction vanes at intake port according to claim 10, and further comprising a cylindrical guard surrounding said large-sized suction vanes and mounted on the lower end of said pump casing.

* * * * *